US005881737A

United States Patent [19]

Nelson

[11] Patent Number: 5,881,737

[45] Date of Patent: Mar. 16, 1999

[54] METHOD OF ATTACHING A HAIR WEFT TO THE HAIR OF A WEARER

[75] Inventor: Charles W. Nelson, Lee's Summit, Mo.

[73] Assignee: Apollo Products, Inc., Kansas City, Mo.

[21] Appl. No.: 942,513

[22] Filed: Oct. 2, 1997

[51] Int. Cl.[6] ..... A41G 3/00

[52] U.S. Cl. ..... 132/201; 132/53

[58] Field of Search ..... 132/201, 53, 54, 132/55, 56

[56] References Cited

U.S. PATENT DOCUMENTS

| | | | |
|---|---|---|---|
| 5,082,010 | 1/1992 | Skaryd et al. | 132/201 |
| 5,107,867 | 4/1992 | Barrington | 132/201 |
| 5,121,761 | 6/1992 | Meister | 132/201 |
| 5,413,124 | 5/1995 | Incando | 132/201 |

*Primary Examiner*—Todd E. Manahan
*Attorney, Agent, or Firm*—Hovey, Williams, Timmons & Collins

[57] ABSTRACT

An improved method of attaching a hair weft (14) to the hair (12) of a wearer (10) is disclosed wherein the hair (12) is first parted along a first parting line (26) corresponding generally to the occipital bone of the wearer (10). Next, an upper portion (28) of hair (12) is folded upwardly relative to the parting line (26) and detachably secured with the hair (12) located above the parting line (26), while a lower portion (30) of hair (12) extends downward relative to the parting line (26). After the lower portion (30) of hair (12) is cleaned, a first segment (34) of the lower portion (30) is folded upwardly relative to the parting line (26) and detachably secured with the hair (12) located above the parting line (26), while a corresponding second segment (36) of the lower portion (30) extends downwardly relative to the parting line (26). The hair weft (14), which includes a plurality of hair stands (18) secured to a base element (16), is next positioned proximal to parting line (26). The inward surface of the base element (16) is then attached to the second segment (36). The first segment (34) is folded downwardly relative to the parting line (26) and over the base element (16) and then attached to the outward surface (20) of the base element (16). Upper portion (28) is folded downwardly relative to the first parting line (26) and over the first segment (34) and the base element (16). An adhesive that substantially spans the width of the inward and outward surfaces of the base element (16) is preferably used to attach the base element (16) to the first and second segments (34, 36). The method preferably includes positioning and attaching a plurality of wefts (14) that are spaced substantially equal distances from each other along the length of the parting line (26). The steps above are preferably repeated for a plurality of additional, spaced apart parting lines each positioned above and generally parallel to the first parting line (26).

5 Claims, 1 Drawing Sheet

METHOD OF ATTACHING A HAIR WEFT TO THE HAIR OF A WEARER

BACKGROUND OF THE INVENTION

1. Field of the Invention

The present invention relates to methods and techniques for providing the appearance of lengthened hair. More particularly, it is concerned with an improved method wherein at least one weft of hair is attached to the hair of a wearer.

2. Description of the Prior Art

Long, flowing hair is often considered to be a fashion statement in of itself. Unfortunately, because human hair typically grows less than one inch a month, naturally long hair cannot be readily attained in the same manner as a new outfit, for example. To satisfy a spontaneous need for long hair, hair extensions or wefts are often employed for such purposes.

It is known in the art to attach hair extensions to a person's relatively short, natural hair to create the appearance of longer hair. For example, one such commonly known method involves the interweaving or braiding of a plurality of hair extensions with the tufts or strands of the wearer's natural hair. However, such method of attachment typically involves expensive, complicated and time-consuming hair styling procedures. Another method involves use of a clip apparatus to attach the extension to the wearer's hair. This method unfortunately does not provide a free-flowing appearance of longer hair because the clip apparatus is ordinarily not hidden, and the extensions are often prone to inadvertent detachment.

SUMMARY OF THE INVENTION

The problems outlined above are in large measure solved by the improved method of attaching a hair weft in accordance with the present invention. That is to say, the method hereof is specially designed to provide easy and quick attachment of a hair weft to a wearer's hair and is a cost-effective means for attaining the appearance of long, flowing hair.

The method of the present invention concerns a hair weft that includes a plurality of hair strands secured to a base element. The method broadly includes the steps of parting the hair of the wearer along a parting line that corresponds generally to the occipital bone of the wearer; folding an upper portion of the parted hair upwardly and temporarily securing the upper portion with the wearer's hair located above the parting line, while leaving a lower portion of the parted hair extending downwardly relative to the parting line; cleaning the lower portion of hair; folding a first segment of the lower portion of freshly cleaned hair upwardly and temporarily securing this segment with the wearer's hair located above the parting line, while leaving a second segment of the lower portion of hair extending downwardly relative to the parting line; positioning the base element of at least one hair weft preferably ¼-inch to ½-inch below the parting line and then attaching the inward surface of the base element to the second segment of hair preferably using an adhesive spanning the width of the base element; folding the temporarily secured first segment of hair downwardly and over the base element and then attaching the first segment to the outward surface of the base element preferably using an adhesive in the same manner as the inward surface attachment, and finally folding the temporarily secured upper portion downwardly and over the first segment and the base element.

The preferred method includes positioning and attaching a plurality of evenly spaced hair wefts proximal to the parting line in the same manner as described above. Alternatively, a single hair weft may be used, with the base element of such weft having a width that is generally equal to the length of the parting line. Further, the steps above are preferably repeated for additional, spaced apart parting lines located above the initial parting line, with each additional parting line being generally parallel to each other and spaced approximately one inch apart. The last parting line should be spaced at least one inch below the crown of the wearer's head.

DETAILED DESCRIPTION OF THE PREFERRED EMBODIMENT

Figures 1, 2, 3, 4, 5:
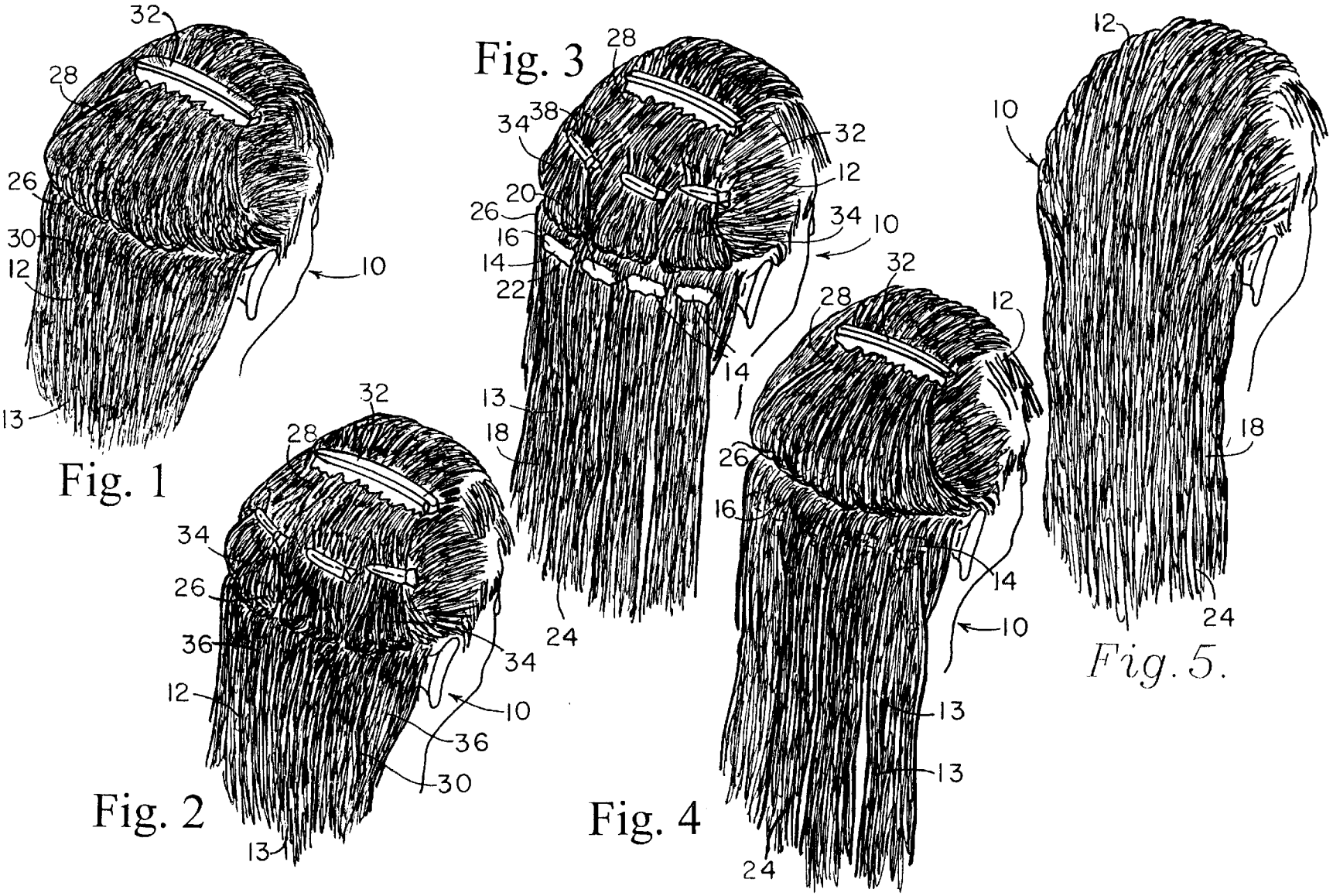
FIG. 1 is a pictorial view of a person with relatively short hair, showing an upper portion of the hair folded up and temporarily secured above a parting line, while a lower portion of the hair extends downwardly relative to the parting line.
FIG. 2 is similar to that of FIG. 1, but showing three segments of the lower portion of hair folded up and temporarily secured above the parting line.
FIG. 3 is similar to that of FIG. 2, but showing four hair wefts positioned just below the parting line and attached to the lower portion of hair.
FIG. 4 is similar to that of FIG. 3, but showing the three segments of hair folded down and attached to the four hair wefts.
FIG. 5 is similar to that of FIG. 4, but showing the upper portion of hair folded down and blended in with the hair wefts.

Referring to the drawing figures, FIG. 1 illustrates a wearer or person 10 with relatively short, natural hair 12 having free-flowing hair ends 13 prior to the attachment of at least one hair weft 14 in accordance with the method of the present invention. As illustrated in FIG. 3, each hair weft 14 includes a base element 16 and a plurality of hair strands 18. Base element 16 presents inward and outward surfaces (only outward surface 20 is shown). Each hair strand 18 has a free-flowing end 22 and a connection end 24, with each connection end 24 being secured to base element 16. Each hair strand 18 presents a length that is greater than the length of hair 12 of person 10 and is preferably colored to generally correspond to the natural color of hair 12. Base element 16 is preferably a band of double-sided adhesive tape that circumscribes and secures the plurality of hair strands 18 adjacent connection ends 24 such that inward and outward surfaces 20 each present an adhesive face for attachment purposes. Alternatively, base element 16 may comprise a bead of binding agent or adhesive that circumscribes the plurality of hair stands 18 adjacent connection ends 24. Such binding agent or adhesive may be one of several well-known substances used in the hair care profession. In addition, base element 16 may comprise a thin, generally rectangular sheet of plastic film to which each connection end 24 of hair strand 18 is secured by such binding agent or adhesive.

The method of attachment of the present invention broadly includes the steps of first parting hair 12 along a first parting line 26 corresponding generally to the occipital bone of person 10. The occipital bone (not shown) runs generally horizontally across the back of a person's head between the ears. After hair 12 is parted along parting line 26, an upper portion 28 of hair 12 is positioned above parting line 26, and a lower portion 30 of hair 12 is positioned below parting line 26. Upper portion 28 is then folded upwardly and temporarily and detachably secured to hair 12 located above parting line 26 using a barrette 32. It will be appreciated that one or more bobby pins, hair clips or other similar devices may be used to detachably secure upper portion 28 in such manner.

Once upper portion 28 is folded upwardly, lower portion 30 extends downwardly relative to parting line 26. Lower portion 30 is next cleaned using a conventional cleaning agent that removes dirt and oil accumulations from lower portion 30 of hair 12. One of many well-known substances in the hair care art for cleaning hair may be used for such purposes.

As illustrated in FIG. 2, lower portion 30 of hair 12 is divided into at least one set of first and second segments 34 and 36 of freshly cleaned hair (three sets are depicted). Each first segment 34 is then folded upwardly relative to parting line 26 and temporarily and detachably secured to hair 12 located above parting line 26 using one or more hair clips 38 or other similar devices. Each second segment 36 is located below first segment 34 and extends downwardly relative to parting line 26. It will be appreciated that the number of segments 34,36 used and the width of each segment 34,36 will ultimately depend upon the corresponding number and width of hair wefts 14 being attached to hair 12. As discussed further below, each first segment will preferably cover all or at least a substantial portion of base element 16 of each weft 14 when first segment 34 is folded downwardly relative to parting line 26 and over each corresponding base element 16.

Turning now to FIG. 3, four hair wefts 14 are positioned such that each base element 16 is preferably ¼-inch to ½-inch below parting line 26. If a plurality of hair wefts 14 are being used, each hair weft 14 is preferably spaced along and relative to parting line 26 in substantially equal distances from each other such that hair wefts 14 generally span the length of parting line 26. On the other hand, a single hair weft 14 may be used that presents a width that is substantially equal to the length of parting line 26.

Inward surface of each base element 16 is then attached to each corresponding second segment 36 of hair using an adhesive or binding agent preferably spanning the width of base element 16. As discussed above, such adhesive or binding agent may be an integral part of base element 16 if base element 16 preferably comprises a band of double-sided adhesive tape that circumscribes hair strands 18 adjacent connection ends 24. It will be appreciated by those skilled in the art that the step of cleaning lower portion 30 of hair 12 prior to such attachment will insure that a significant amount of dirt and oil accumulations are removed from lower portion 30 and will therefore not impede proper attachment of each weft 14 in the manner discussed herein.

Each first segment 34 is detached from hair 12 located above parting line 26 and folded downwardly relative to parting line 26 and over each corresponding base element 16, as illustrated in FIG. 4. Once folded over in such manner, first segments 34 should cover all or at least a substantial portion of each attached hair weft 14. Each first segment 34 is then attached to outward surface 20 of base element 16 in the same manner as discussed above in respect of the attachment of the inward surface of base element 16 to second segment 36. To insure proper attachment of base element 16 to lower portion 30 of hair 12, each set of first and second segments 34, 36 should be pressed firmly together with base element 16 sandwiched therebetween. The fingers of the hair care technician may be used to press first and second segments 34, 36 together, or a crimping tool or other similar device commonly used in the hair care industry may be employed for such purposes.

Turning finally to FIG. 5, upper portion 28 is detached from hair 12 located above parting line 26 and folded downwardly relative to parting line 26 and over each first segment 34 and base element 16. To promote the appearance of naturally, long flowing hair, upper portion 28 of hair 12 is preferably blended in with the plurality of hair strands 18 of each weft 14.

The foregoing steps are then preferably repeated for a plurality of additional, spaced apart parting lines (not shown) each positioned above and generally parallel to first parting line 26. The lowermost additional parting line should be spaced a distance of approximately one inch from first parting line 26. Each additional parting line should be spaced approximately one inch from each other. The uppermost parting line should be spaced at least approximately one inch below the crown of the head of person 10.

Once each hair weft has been properly attached and each upper portion 28 has been blended in with the plurality of hair strands 18 of each weft 14, hair 12 and hair wefts 14 may now be coiffed in any number of styles appropriate for a person having long, flowing hair.

What is claimed is:

1. A method of attaching a hair weft to the hair of a wearer, the weft including a base element and a plurality of hair strands, the base element presenting opposed inward and outward surfaces, each hair strand having a free-flowing end and an opposed connection end, each connection end being secured to the base element, the method comprising the steps of:

(a) parting the hair of the wearer along a first parting line corresponding generally to the occipital bone of the wearer such that an upper portion of the hair of the wearer is positioned above the first parting line and a lower portion of the hair of the wearer is positioned below the first parting line;

(b) folding the upper portion upwardly relative to the first parting line and detachably securing the upper portion with the hair of the wearer located above the first parting line while leaving the lower portion extending downwardly relative to the first parting line;

(c) cleaning the lower portion of hair;

(d) folding a first segment of the lower portion of hair upwardly relative to the first parting line and detachably securing the first segment with the hair of the wearer located above the first parting line while leaving a second segment of the lower portion extending downwardly relative to the first parting line;

(e) positioning the base element of the weft approximately one-quarter inch to one-half inch below the first parting line;

(f) attaching the inward surface of the base element to the second segment of hair;

(g) folding the first segment of hair downwardly relative to the first parting line and over the base element;

(h) attaching the first segment of hair to the outward surface of the base element; and (i) folding the upper portion of hair downwardly relative to the first parting line and over the first segment of hair and the base element of the weft.

2. The method of claim 1, including repeating the steps of (d) through (i) for a plurality of wefts, the method including the step of dividing the lower portion into a plurality of first and second segments such that the first segments cover at least a portion of the base element of each weft when the first segments are folded downwardly relative to the first parting line and over each base element.

3. The method of claim 2, the first parting line presenting a length, step (e) including the step of spacing the base elements of the wefts along the first parting line in substantially equal distances from each other such that the wefts substantially span the length of the first parting line.

4. The method of claim 1, including repeating steps (a) through (i) for a plurality of additional, spaced apart parting lines each positioned above and generally parallel to the first parting line.

5. The method of claim 4, the additional parting lines including a lowermost additional parting line and an uppermost additional parting line, the lowermost additional parting line being spaced a distance of approximately one inch from the first parting line, the additional parting lines each being spaced a distance of approximately one inch from each other, the uppermost additional parting line being spaced at least approximately one inch below the crown of the head of the wearer.

* * * * *